US006142829A

United States Patent [19]

O'Groske et al.

[11] Patent Number: 6,142,829

[45] Date of Patent: Nov. 7, 2000

[54] FERRITE BLOCK IN A CABLE CONNECTOR PREMOLD

[75] Inventors: Rolland Dean O'Groske; Glenn Ray Oldenburg; Scott Marvin Thorvilson; Randall Vincent Tointon, all of Rochester, Minn.

[73] Assignee: International Business Machines Corporation, Armonk, N.Y.

[21] Appl. No.: 08/909,755

[22] Filed: Aug. 12, 1997

[51] Int. Cl.[7] ..... H01R 13/66

[52] U.S. Cl. ..... 439/620

[58] Field of Search ..... 439/620, 610, 439/607, 606, 621

[56] References Cited

U.S. PATENT DOCUMENTS 4,761,147 8/1988 Gauthier ..... 439/620
4,822,304 4/1989 Herron ..... 439/610

FOREIGN PATENT DOCUMENTS

WO 8804841 6/1988 European Pat. Off. ..... 439/620

*Primary Examiner*—Paula Bradley
*Assistant Examiner*—Briggitte R. Hammond
*Attorney, Agent, or Firm*—Laurence R. Letson

[57] ABSTRACT

An electrical connector for computer cabling or similar types of cabling wherein data signals are transmitted over the cables is described and illustrated as having a ferrite electro-magnetic interference suppressor element surrounding the conductors of the cable and all of which are enclosed and incorporated within the connector assembly. The enclosure and incorporation of the ferrite suppression element within the connector assembly greatly improves the performance of the ferrite device while, at the same time, permitting the use of space within the connector assemblies which otherwise might be wasted or unused. The incorporation of the ferrite device into the housing permits the placement of the ferrite device at the optimum location for electromagnetic interference suppression.

5 Claims, 1 Drawing Sheet

FERRITE BLOCK IN A CABLE CONNECTOR PREMOLD

FIELD OF THE INVENTION

This invention relates to the construction and structure of computer signal cables and more specifically to computer signal cables having a ferrite electronic noise suppression element incorporated therein.

BACKGROUND OF THE INVENTION

Ferrite toroids are commonly used on data cables to suppress common mode current in the cable assembly, suppressing electro-magnetic interference or noise.

Ferrite toroids have been threaded onto or placed onto bulk cable and attached as close to the noise source as possible. Congestion at or near the connection interface between the cable and the computer or display or other electronic component sometimes creates the need in the cable for a sharp bend radius where the ferrite toroid would be placed; and other physical spatial requirements such as size and the toroid size and/or shape of adjacent connectors may dictate the location of a toroid several inches from the connector. Cables are efficient radiating elements and frequently are a significant source of electro-magnetic interference (EMI), noise or erratic signals on data lines and tend either to disturb the purity of the data signals or other signals sent over the cables or otherwise to create undesirable radiation of electro-magnetic interference or noise into the surroundings, thus creating interference for other closely located electronic devices such as other computers, radios and television receivers.

A ferrite toroid suppresses the noise by acting as a series impedance element both to the common mode current typically found on the data lines and the cable shield of a data cable without suppressing the differential current on the data lines used to convey the data.

In prior practices, a ferrite toroid typically has been attached by one of various techniques to the bulk portion of the cable and, particularly, to the cable exterior. One technique previously used includes the use of wire ties or adhesive to attach the toroid to the exterior of the cable insulation as well as to confine the toroid within shrink tubing; the tubing is caused to shrink to confine the toroid in a desired location relative to the bulk insulated cable.

An alternative approach has been to remove or lay back the insulation and braid of the cable shield and to place the toroid under the braid of the cable shield and then to re-braid the cable shield. The braid then must be externally re-insulated. This technique has proven to be undesirable due to the cost involved.

Typical cables used for cabling computer components are made up of a plurality of electrical conductors, typically wires made of copper, which are insulated individually and then gathered together in a bundle and surrounded by a metal foil and a braided metal wire shield. The braided wire shield or cable shield sleeve typically is further surrounded or is wrapped around a thin metal foil, forming the cable shield. To complete the formation of the bulk cable, the cable shield and insulated electrical conductors and the foil wrap are encased in a vinyl, rubber or similar polymeric insulating sleeve.

The prior approaches to electronic noise suppression using ferrite toroids placed the ferrite toroids on the exterior of the outer insulating sleeve or cable jacket and then additionally confined their movement by utilizing one of the techniques described above. Placement on the exterior of the insulating outer sleeve, while generally effective, is not as efficient as the placement of the toroid in closer proximity to, or in contact with, the wire braid cable shield; the most efficient EMI suppression dictates that the diameter of the hole in the toroid be as small and as close as possible to the data conductors. An outer insulation sleeve of substantial thickness diminishes the effectiveness of the toroid. The ferrite EMI or noise suppression element is preferably placed as close to the end of each of the electrical conductors as is possible and, similarly, as close to the electrical conductors themselves as possible. The positioning of the ferrite toroid on the exterior of the bulk cable is generally considered at best to be a compromise dictated by cable size and the constraints imposed by the congestion near the cabling interface with the electronic module.

OBJECTS OF THE INVENTION

It is an object of the invention to dispose the ferrite noise suppression element as close to the noise source as is physically possible.

It is another object of the invention to incorporate the ferrite noise suppression element into the space occupied by the connector assembly terminating the cable with which the ferrite element is associated.

It is still another object of the invention to eliminate the need to attach a ferrite toroid on the exterior of the bulk cable portion of the cable assembly.

It is a further object of the invention to dispose the ferrite suppression element in a relationship with a cable whereby the most effective noise suppression achievable is accomplished.

SUMMARY OF THE INVENTION

These objects of the invention and others are accomplished and the disadvantages of the prior art are overcome by inclusion of the ferrite suppression element within the space occupied by the cable connector assembly or overmold structure. The connector assembly typically is comprised of a connector element for mating with a similar mating connector mounted on either another cable connector or on an electronic device such as a computer component. The connector typically has a plurality of electrical contacts which mate with corresponding electrical contacts on a mating connector to which it is connected, and each contact may have a discreet conductor attached or terminated to the electrical contact providing a signal path through the cable to the connector contact.

The individual discreet conductors are freed from the confines of the bulk cable insulation or cable jacket and shielding by stripping the outer insulation sleeve and the cable shield or wire braid. The discreet insulated conductors then may be threaded through the ferrite device and terminated on the termination contact of the connector. This constitutes a subassembly by which the electrical characteristics of this device have been defined.

The connector, the conductors, the ferrite device, and the cable then may be inserted into a mold as a mold insert and a premold compound or material injected into the openings between the discreet insulated conductors and encasing the ferrite block or device to create a body. Once the body has been premolded, then it may be overmolded with the exterior insulating material which forms the outer form or overmold of the connector assembly. The overmold may be formed to permit the connector assembly to be further supplied with retaining screws.

A second embodiment of the device is one wherein the discreet insulated conductors are terminated at the connector, and the premold includes the connector, insulated conductors and the bulk cable and a ferrite toroid surrounding the cable in close proximity to, or in contact with, the cable shield. Either prior to or after the assembly of the premold, a ferrite toroid may be disposed to surround the cable shield or wire braid. Once this assembly has been completed, then the overmold may be molded surrounding the premold such that the ferrite toroid is maintained in position relative to the cable shield and, yet at the same time, is totally enclosed within and forms a part of the connector assembly.

The two described embodiments provide the advantage of locating the ferrite toroid as close as reasonably possible to the connector, typically a major or primary source of the electronic noise, and thereby making the ferrite noise suppression element most efficient. The inclusion of the ferrite toroid or the ferrite block within the connector assembly reduces the amount of space required for an EMI noise suppressor and additionally utilizes a volume of space which quite possibly would be wasted or otherwise unused.

DETAILED DESCRIPTION OF THE PREFERRED EMBODIMENT OF THE BEST MODE CONTEMPLATED BY THE INVENTORS

Figure 1:
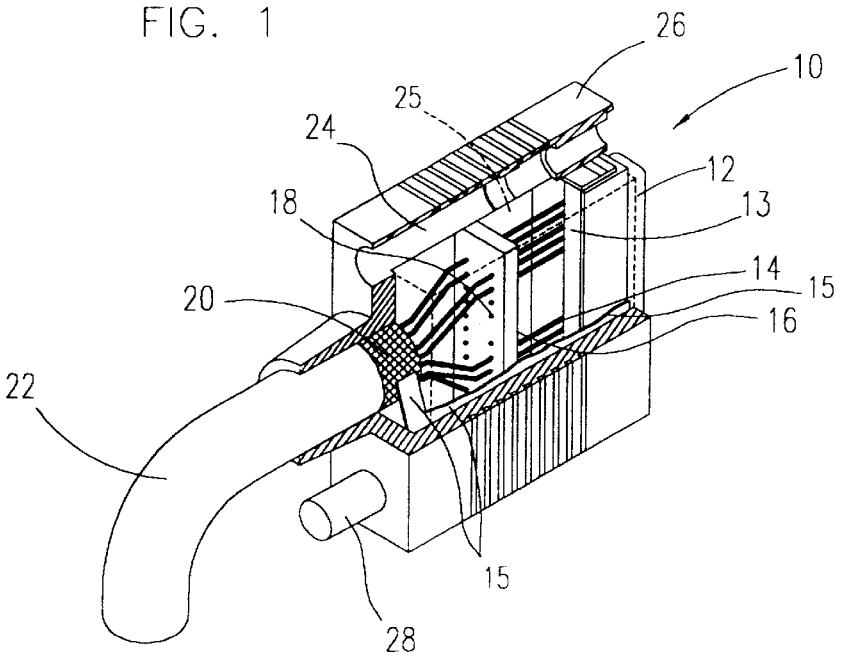
FIG. 1 illustrates, in partially broken-away form, a perspective view of an electronic cable assembly which incorporates a ferrite block to suppress electronic noise disposed within the volume of the premold of the connector assembly.

Referring initially now to FIG. 1, the partially broken-away illustration of a cable connector assembly 10 is shown in a perspective view. Connector assembly 10 has a connector 12 which is a conventional cable connector, typically a D-shell connector, but need not necessarily be of the particular configuration illustrated. Connector 12 is illustrated as having a plurality of insulated conductors 14 extending from the back or reverse side 13 thereof. The conductors 14 extend away from the side 13 opposite the mating contact region of connector 12. The individual insulating conductors 14 extend through a ferrite block or toroid 16 which has formed therein a plurality of holes or passages 18. Insulating conductors 14 thus may individually pass through openings or holes 18 to create the ferrite/conductor relationship which is known and recognized to reduce EMI or electronic noise.

The insulated conductors 14 are illustrated as being routed between the connector 12 and cable 22. The cable 22 is preferably a shielded cable with a wire braid shield 20 which may be a plurality of fine metal wires or strands, extending along and surrounding and wrapped in about the bundle of insulated conductors 14. The shielded cable 20 also may incorporate a metal foil (not shown) further surrounding the conductor bundle and within cable shield 20. The metal foil is not illustrated as it typically is removed from the cable shield 20 at the exposed region to permit premolding and the subsequent grounding of the wire braid 20 of the cable shield 20 to the D-shell 11 of the D-connector 12 through a copper foil 15 or tape 15. This grounding connection is preferably a wrapping of copper foil on a tape wrapped about the premold 25 and soldered to both the cable shield 20 and the D-shell of the connector 12.

The connector 12, individual insulating conductors 14, ferrite block 16, and cable 22 are insert-molded with a material of the polypropylene family to form a premold 25 or a form spatially defining the different locations of the elements of the electronic apparatus.

Following the formation of the premold 25 or block 25 containing the connector 12, insulating conductors 14, and ferrite block 16, then the premold 25 is used as a molding insert and the overmold 26 is formed around the premold 25 to not only encapsulate the premold 25 with the exception of the mating connector interface, but also to partially encapsulate the end of the cable 22. Thus, the entire cable connector assembly 10 is sealed within the overmold 26 for not only its electrical insulation properties but also to provide contamination protection and cable strain relief.

The overmold 26 may incorporate channels 24 through the connector assembly 10, if desired. Channels 24 will accommodate an attaching screw, such as screw 28, to permit the fixed attachment of the connector assembly 10 to the computer or electronic equipment module (not shown), as is conventional.

The ferrite block 16, being formed to accommodate the insulated conductors 14 on an individual basis through the plurality of holes 18, allows the ferrite material to be placed as closely as possible to the conductor 14, only the thickness of the insulation separating the conductor 14 and the ferrite block 16, but also permits the ferrite block 16 to be disposed as closely as possible to the termination of the individual conductors 14 to the connector 12. If desired, the ferrite block 16 could have a single hole and encircle all the conductors 14. While the ferrite block 16 is illustrated as being displaced slightly from the back side 13 or termination side 13 of the connector 12, the ferrite block 16 may be placed as closely to the connector 12 as it may be positioned.

Figure 2:
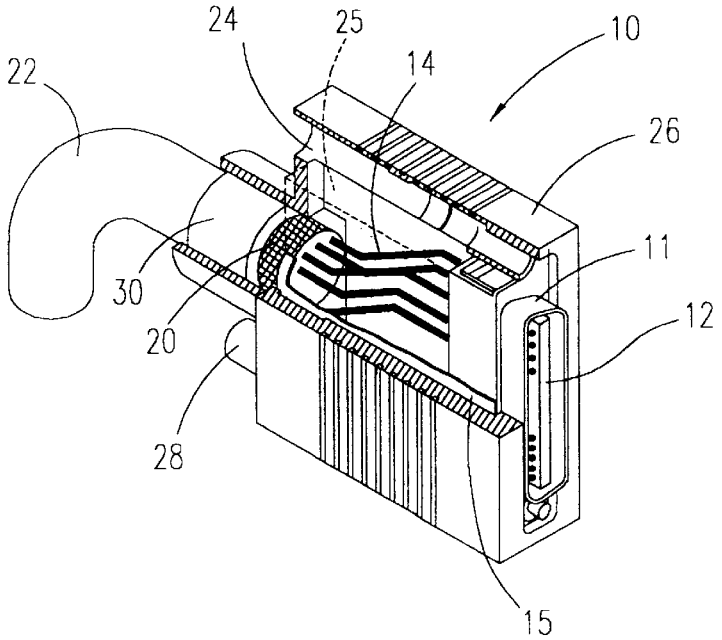
FIG. 2 illustrates, in partially broken-away form, an electronic cable assembly wherein the ferrite suppression element surrounds and is in close proximity to the bulk cable shield, while at the same time the ferrite element is incorporated within the overmolded housing of the cable assembly.

Referring now to FIG. 2, a second embodiment of the illustration is illustrated in a partially broken-away perspective view of a cable connector assembly 10.

Similar to the connector assembly 10 in FIG. 1, the connector assembly 10 has a connector 12, such as a D-connector, which has terminated on its back side 13 individual insulated conductors 14 extending from cable 22. The cable shield 20, typically a wire braid surrounding the bundle of insulated conductors 14, is exposed during the fabrication process. The exposed wire braid cable shield 20 may have, internal thereto, a metal foil shield (not shown); and, in that case, the metal foil is similarly stripped from the wire bundle of conductors 14. A ferrite toroid 30 is disposed in close proximity to and surrounding the wire braid cable shield 20 and is disposed as closely as possible, design constraints considered, to the terminations of the conductors 14 at the connector 12. The close proximity between the ferrite toroid 30 and the cable shield 20 is an advantageous aspect of this invention as it insures the maximum efficiency in EMI and electronic noise suppression which is not as efficiently accomplished whenever the ferrite toroid 30 is disposed around the insulation or jacket of the bulk cable 22.

The individual insulated conductors 14, the connector 12, and the cable 22 may be fixed in their spatial relationship to each other within a premold 25 which can be formed of a polypropylene material injected around the various elements to fix the various elements relative to the other elements. Once the premold 25 is molded, the premold 25 may be wrapped in copper foil tape and the cable shield braid soldered to the copper foil and the foil soldered to the shell of the connector 12 and ferrite toroid 30 disposed circumscribing or surrounding the cable shield 20. The premold and the ferrite toroid 30 then may be enclosed or encased in the overmold 26, a material which typically is insulative and to some degree is deformable. The overmold 26 further may be provided with channels 24 to accommodate retaining screws 28. The placement of the ferrite toroid 30 within the confines of the connector assembly 10 and in close proximity to the cable shield 20 greatly increases its effectiveness while at the same time utilizes a spatial volume which might have been otherwise unused or wasted. The placement of the ferrite toroid 30 in close proximity to and at or near the end of the cable shield 20 in close proximity to the connector 12 further enhances its efficiency in noise suppression.

Disposition of the ferrite toroid 30 within very close proximity to a noise source, the conductors 14 and connector 12, and its more efficient construction with regard to the close proximity to and surrounding the cable shield 20 may permit a reduction in the size of the ferrite toroid 30 such that any increase in the size of the connector assembly 10 in order to accommodate the ferrite toroid 30 may be minimized.

The cable shield 20 in both the embodiments of FIGS. 1 and 2 typically is connected by conductive foil 15 to the outer shell 11 of the D-connector 12 to provide shielding of the mating conductor 12 interface. The conductive foil 15, preferably copper foil tape, entirely wraps the premold 25 except for the mating portion of connector 12.

It is understood that the premolding is not necessarily a required step if all of the elements may be held in the proper position prior to the molding of the overmold. However, it may be desirable to continue to use the premold approach from an efficiency standpoint if it is difficult to pre-position the connector 12, all of the insulated conductors 14, the ferrite toroid 30 and the cable 22.

A further advantage of the two embodiments described herein is that the cable assembly, including the connector assembly, does not have large unsightly toroid assemblies disposed on the exterior of the cable to create additional problems for the user in connecting or disconnecting the connector assemblies to the computer modules.

While two particular embodiments have been illustrated herein, it should be understood that the shape and formation of the ferrite electro-magnetic interference or noise suppression element may be formed in any manner which is effective to provide the suppression function; however, at the same time, the connector assembly must be formed to accommodate the inclusion of the ferrite element within the connector housing. For example a ferrite block may be encased within the premold with a single or few openings for the conductors to pass through.

Accordingly, minor changes in shape or structure may be made without removing the resulting device from the scope of protection provided by the attached claims.

We claim:

1. An electrical cable connector assembly comprising:

an electrical connector adapted to electrically interconnect with a mating connector;

an electrical cable having a plurality of electrical conductors each terminated at an electrical contact of said electrical connector;

said electrical cable further having shielding element surrounding a predominate portion of said electrical conductors;

an electrical continuity between said electrical connector and said shielding element;

a ferrite toroid circumscribing said shielding element, said ferrite toroid disposed proximate a terminus of and engaging said shielding element, said electrical cable connector assembly having an exterior coating, said exterior coating comprising a molded rigid material, molded to encapsulate said ferrite toroid and said conductors.

2. The electrical cable connector of claim 1 wherein said cable comprises said conductors, insulation surrounding said conductors, and a plurality of metal strands extending along and circumferentially surrounding said insulated conductors and a metal foil surrounding said strands.

3. The electrical cable connector assembly of claim 1 wherein said electrical continuity comprises a foil shield disposed in electrical contact with said shielding element and said connector.

4. The electrical cable connector assembly of claim 3 wherein said foil shield is disposed circumscribing said ferrite toroid and said insulated conductors.

5. An electrical cable connector assembly comprising:

an electrical connector adapted to electrically interconnect with a mating connector;

an electrical cable having a plurality of electrical conductors each terminated at an electrical contact of said electrical connector;

said electrical cable further having shielding element surrounding a predominate portion of said electrical conductors;

a ferrite toroid circumscribing said shielding element, said ferrite toroid disposed proximate a terminus of said shielding element, said toroid physically and electrically contacting said shielding element;

an electrically conductive foil enveloping said plurality of electrical conductors and electrically connected to said electrical connector and said shielding element, and said exterior coating comprising a molded rigid material, encapsulating said ferrite toroid and said conductors.

* * * * *